United States Patent [19]

Ohneda et al.

[11] Patent Number: 5,069,055

[45] Date of Patent: Dec. 3, 1991

[54] AUTOMATIC PLUG-INSERTING APPARATUS IN A PIPE-DRAWING EQUIPMENT

[75] Inventors: Noboru Ohneda, Oyamashi; Shunta Ushioda, Yukishi; Haruo Arima, Oyamashi; Ichiro Hashimoto, Oyamashi; Denziro Kaneko, Tochigishi; Kazuo Sugiyama, Shimodateshi; Tsuguo Fukazawa, Oyamashi; Teruo Tachi, Kasa Mashi; Takashi Mukasa, Ykishi, all of Japan

[73] Assignee: Showa Aluminum Kabushiki Kaisha, Osaka, Japan

[21] Appl. No.: 603,127

[22] Filed: Oct. 25, 1990

[30] Foreign Application Priority Data

Nov. 6, 1989 [JP] Japan ..... 1-288528

[51] Int. Cl.[5] ..... B21C 1/32

[52] U.S. Cl. ..... 72/283

[58] Field of Search ..... 72/283, 278, 287, 291, 72/274

[56] References Cited

U.S. PATENT DOCUMENTS 2,492,876 12/1949 McIlvried ..... 72/283
3,250,362 5/1966 Mitchell ..... 72/291

FOREIGN PATENT DOCUMENTS 457626 3/1928 Fed. Rep. of Germany ..... 72/283
3122719 12/1982 Fed. Rep. of Germany ..... 72/283
194815 8/1988 Japan ..... 72/283

*Primary Examiner*—Daniel C. Crane

[57] ABSTRACT

An apparatus for automatically inserting a plug in and to a predetermined position therein a raw pipe such as an aluminum pipe which is to be drawn for instance in a drawbench. The apparatus comprises a suppport roller which supports a plug-supporting rod at its intermediate portion near to an end of the rod, the support roller bearing a lower surface of the portion and being movable along the plug-supporting rod. The apparatus further comprises a pipe-transporting device for transporting the raw pipe, which device grips both ends of the raw pipe so as to move it towards the plug-supporting rod in a direction in alignment with an axis of said rod. A pusher protrudes forward from the pipe-transporting device so that the device starts to carry the support roller at a given instant whereby the raw pipe is prevented from directly riding the support roller and is thus protected from being scratched, and forcible pressing of the plug onto an inner surface of the raw pipe being also avoided.

2 Claims, 2 Drawing Sheets

AUTOMATIC PLUG-INSERTING APPARATUS IN A PIPE-DRAWING EQUIPMENT

BACKGROUND OF THE INVENTION

1. Field of the Invention

The invention relates to an automatic plug-inserting apparatus for automatically inserting a plug in a metal pipe such as an aluminum pipe which is to be drawn and elongated in a pipe-drawing equipment such as a drawbench.

2. Description of Prior Art

The drawing process as one of the processes adapted to draw and elongate aluminum pipes or aluminum-base alloy pipes has been employed particularly in a case in which wanted are ideally straight drawn pipes with a sufficiently uniform thickness of pipe walls. In a further case wherein an especially high precision is required, the so-called plug-drawing method has been adopted by which a plug is inserted in a raw pipe to be drawn.

The plug is attached to an end of a plug-supporting rod so as to be inserted at first in the raw pipe before the plug-drawing method is carried out. The plug is thus positioned inside an opening of a drawing die, and a pointed end which has previously been formed to be of a reduced diameter at an end of the raw pipe is then gripped with a chuck secured to a carriage which is driven by chains. Subsequently, the pointed end is forcibly pulled through the opening of said die so that the raw pipe is drawn to obtain its elongated shape.

Therefore, plug-inserting apparatuses are known and they have generally been used to automatically insert the plug prior to performance of the drawing method described above.

FIG. 4 illustrates one of the known plug-inserting apparatuses wherein the plug 84 is attached to a leading end of the plug-supporting rod 81 which is held at its trailing end by a support block 86 in such a state as forming a cantilever mechanism. A bottom of a portion near the leading end rests on a support roller 85 which keeps horizontal the plug-supporting rod 81. On the other hand, a pusher 83 is disposed opposite to the leading end of said plug-supporting rod so that the raw pipe 82 to be drawn can be set between the pusher 83 and the plug 84 in alignment with their axes. The raw pipe 82 is then pushed by the pusher 83 towards the plug 81, which is to be inserted in the pipe in this manner.

However, such a known plug-inserting apparatus is likely to cause scratches on surfaces of the drawn pipes, and thus inadequate for some cases wherein photosensitive base drums are manufactured to which photoconductive selenium or other organic photosensitive substances are to be applied. The photosensitive base drums must be provided with as high surface quality as possible for use in the electronic copiers or laser printers.

An outer surface of the raw pipe 82 pushed by the pusher 83 is usually scratched by a bed surface 87 on which said pipe is dragged. Further, after a leading end of the raw pipe 82 has gone beyond the support roller 85, the outer surface of said pipe itself comes into direct contact with the support roller 85, this contact also causing scratches on the outer surface of the raw pipe 82.

In addition, an axis of the raw pipe 82 cannot be aligned with an axis of the plug-supporting rod 81 any more also after said leading end of the pipe 82 has advanced ahead past the support roller 85 as shown in FIG. 5. Consequently, the plug 84 may be forced into the pipe and be early abraded thereby to shorten the life of said plug.

OBJECTS AND SUMMARY OF THE INVENTION

A primary object of the present invention which was made to obviate the drawbacks in the abovementioned prior art is therefore to provide an automatic plug-inserting apparatus which will neither scratch a raw pipe to be drawn in a plug-drawing equipment nor shorten the life of a plug which is to be inserted in the raw pipe.

Other objects and advantages of the invention will become apparent from preferred embodiments which will be described hereinafter referring to the drawings.

The primary object will be accomplished in the invention by providing an automatic plug-inserting apparatus for automatically inserting a plug in a raw pipe which is to be drawn in a plug-drawing equipment, wherein the plug is secured to a free end of a plug-supporting rod which in turn is supported by a support roller at its intermediate portion near to the plug, the support roller thereby bearing a lower surface of the plug and being movable along the plug-supporting rod. The automatic plug-inserting apparatus further comprises a pipe-transporting device for transporting the raw pipe, which device comprises members for gripping both ends of the raw pipe so as to move it towards the plug-supporting rod in a direction in alignment with an axis of said rod, to thereby insert the plug into the raw pipe. The automatic plug-inserting apparatus still further comprises a pushing means for pushing the support roller, which means is equipped on the pipe-transporting device such that the support roller is shifted towards a fixed end of the plug-supporting rod before a leading end of the raw pipe contacts and advances beyond the support roller while the plug is being inserted into the raw pipe.

In the automatic plug-inserting apparatus in the invention, there is no possibility that an outer surface of the raw pipe transported is scratched, because the raw pipe is gripped at its both ends. The leading end of the raw pipe to be drawn will never advance beyond the support roller because this roller is shifted by the pusher towards the fixed end of the rod having one end secured to the plug, lest said leading end should come into contact with said roller. Thus, the outer surface of the raw pipe into which the plug is inserted does not contact the support roller to be scratched thereby. Further, the plug is not pressed to an inner surface of the raw pipe in the apparatus according to the invention.

DETAILED DESCRIPTION OF PREFERRED EMBODIMENTS

Figure 1:
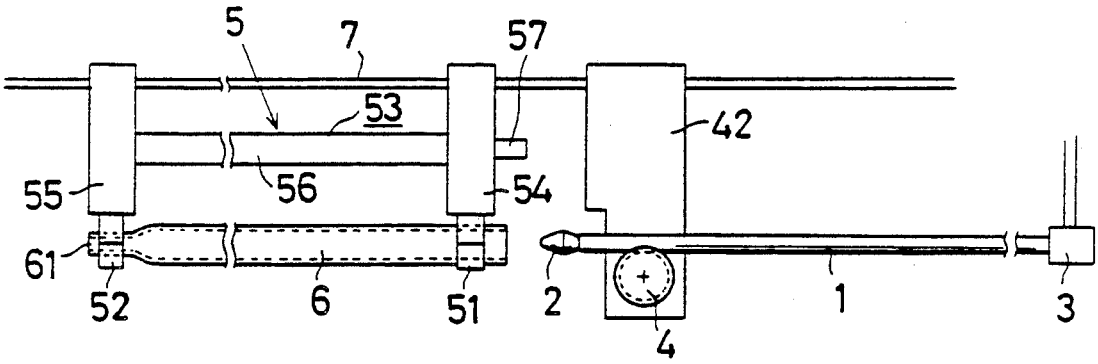
FIG. 1 is a side elevation of an automatic plug-inserting apparatus in an embodiment of the invention.

Embodiments of the invention will now be described in detail referring to the drawings.

In an automatic plug-inserting apparatus shown in FIG. 1, the reference numeral 1 denotes a plug-supporting rod having an end where a plug 2 is secured to be utilized in a drawing process. The reference numeral 3 denotes a support block supporting the rod in such a manner as if said rod were a cantilever. A bottom of an intermediate portion near the end of the rod 1 rests on a support roller 4. A raw pipe 6 to be drawn is carried by a pipe-transporting device 5 which moves the pipe towards the rod 1 with their axes in alignment with each other.

The support roller 4 is journaled on a roller-supporting body 42 which is directly or indirectly mounted on a guide rail 7 and is movable therealong in a direction in alignment with the axis of the plug-supporting rod 1, the guide rail 7 extending parallel with said axis thereof.

On the other hand, the pipe-transporting device 5 is composed of a pair of grippers 51 and 52 as well as a gripper-holding assembly 53, one of the grippers being located ahead with the other located behind. The gripper-holding assembly 53 comprises a pair of gripper-carrying members 54 and 55 and a connecting body 56 which keeps a constant distance therebetween. One of the grippers 51 grips an outer surface of the raw pipe 6 to be drawn at its leading end, the other gripper 52 gripping at the same time a rear pointed end 61 of raw pipe 6. Both of the gripper-carrying members 54 and 55 of this pipe-transporting device 5 are mounted movably on the guide rail 7 directly or indirectly so that they can be displaced in a direction in parallel with the axis of the plug-supporting rod 1. Thus, the plug 2 can be inserted in the raw pipe 6 gripped and carried by the pipe-transporting device. A drive mechanism ( not shown ) such as a chain reciprocates the pipe-transporting device 5 in a direction of the axis of the rod 1.

A pusher 57 as a pushing means for pushing the roller-supporting body protrudes forward from a portion of one of the gripper-carrying members 54 which is disposed ahead in the pipe-transporting device 5. The portion from where the pusher 57 protrudes faces the roller-supporting body 42. In a process of inserting the plug, the pusher 57 comes into contact with said roller-supporting body 42 before the leading end of the raw pipe 6 reaches the aforementioned support roller 4. Consequently, said support roller 4 is moved ahead towards a fixed end of the plug-supporting rod 1.

Figure 2:
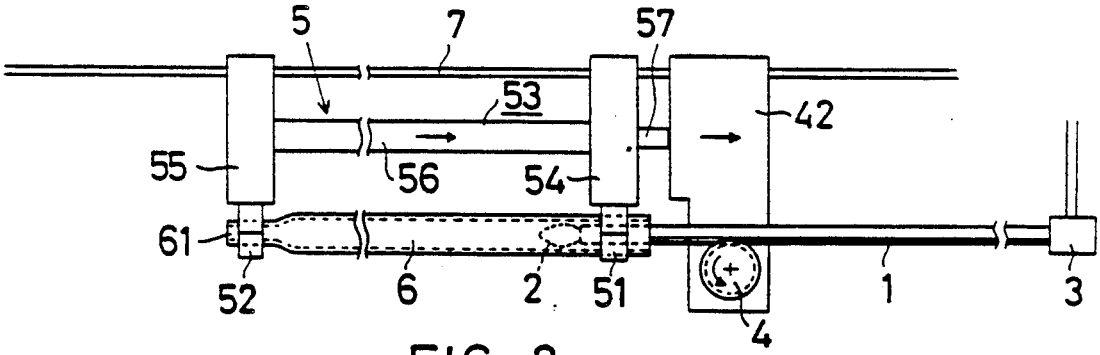
FIG. 2 is a side elevation of the apparatus in such a state that a support roller is being pushed by a pusher towards a fixed end of a plug-supporting rod in the embodiment.
Figure 3:
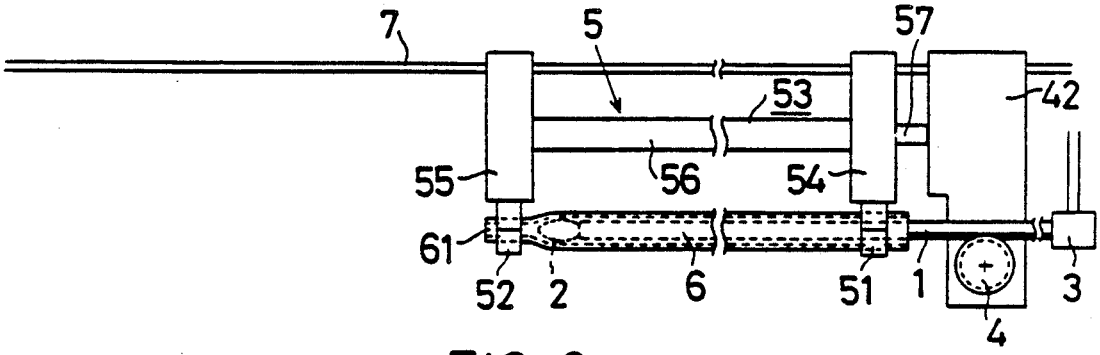
FIG. 3 is a further side elevation of the apparatus in a further state that the plug has been inserted and set at an adequate position adjacent to a pointed end of the raw pipe.
Figure 4:
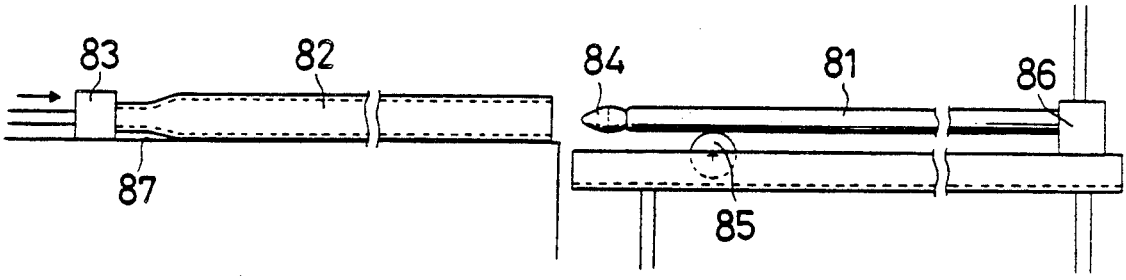
FIG. 4 (Prior Art)
FIG. 4 is a side elevation showing a known apparatus for automatically inserting a plug in prior art.
Figure 5:
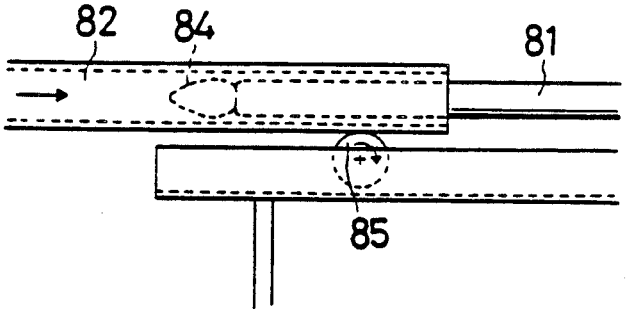
FIG. 5 (Prior Art)
FIG. 5 is an enlarged side elevation showing the known apparatus while the plug is being inserted.

In operation of the automatic plug-inserting apparatus described above, the raw pipe 6 to be drawn is, as shown in FIG. 1, gripped at first at its ends by the grippers 51 and 52 of the pipe-transporting device 5, which has been at its rearward waiting or home position. Subsequently, the drive mechanism is actuated to move said device 5 towards the plug-supporting rod 1. The pusher 57 will then contacts the roller-supporting body 42 before the leading end of the raw pipe 6 advances past the support roller 4, as shown in FIG. 2. Therefore, said support roller 4 is kept apart a constant distance from the leading end of the raw pipe 6 while being caused to make a backward movement towards the fixed end of said plug-supporting rod 1. Finally, the pipe-transporting device 5 will be stopped as shown in FIG. 3 just when the plug 2 has reached a position which is inside the raw pipe 6 and adjacent to the pointed end 61. This raw pipe 6 in which the plug 2 is disposed at an adequate position will undergo a drawing process.

It will now be apparent that in the invention the outer surface of the raw pipe is never scratched because it is gripped at both ends while being transported. Besides, the leading end of the raw pipe will never go beyond the support roller because this roller is shifted in unison with the transporting device by the pushing means towards the fixed end of the plug-supporting rod. Thus, the outer surface of the raw pipe does not contact the support roller to be scratched thereby during the step of inserting the plug. Further, the plug is not pressed to the inner surface of the raw pipe whereby the step of inserting the plug can be carried out without scratching the raw pipe nor shortening the life of the plug.

What is claimed is:

1. An automatic plug-inserting apparatus in a pipe-drawing equipment, the apparatus comprising:

a plug supporting rod fixed at one end to a support means;

a plug secured to an opposite end of the plug-supporting rod;

a support roller for supporting an intermediate portion by rollably engaging a bottom surface of the plug supporting rod of the plug-supporting rod;

the support roller being freely movable along a path in a direction of an axis of and in parallel with the plug-supporting rod;

a pipe-transporting device for moving a raw pipe which is to be drawn, towards the plug-supporting rod having the axis in alignment with an axis of the raw pipe;

the pipe-transporting device fixedly gripping both ends of the raw pipe into which the plug is to be inserted so that the pipe can be moved along the axis while the pipe is gripped;

a pushing means attached to the pipe-transporting device; and the pushing means pushing and starting to carry the support roller along the path in rolling engagement with said bottom surface towards the fixed end of the plug-supporting rod before a leading end of the raw pipe goes beyond the support roller as the pipe-transporting device moves along the axis.

2. An automatic plug-inserting apparatus as defined in claim 1 wherein the pipe-transporting device comprises a gripper-holding assembly, the support roller being held by a roller-supporting body, and wherein the pushing means comprises a pusher (57) protruding forward from the gripper-holding assembly, the pusher capable of bearing against the roller-supporting body so as to carry the support roller towards the fixed end of the plug-supporting rod.

* * * * *